US006447391B1

(12) United States Patent
Kim et al.

(10) Patent No.: US 6,447,391 B1
(45) Date of Patent: Sep. 10, 2002

(54) DEVICE FOR ACTUATING A SHUTTER FORMED THROUGH A FRONT PANEL OF AN AIR CONDITIONER

(75) Inventors: Jung-suk Kim, Suwon-shi; Seung-dae Yang, Asan-shi, both of (KR)

(73) Assignee: Mando Climate Control Corporation, Chungcheongnam-do (KR)

( * ) Notice: Subject to any disclaimer, the term of this patent is extended or adjusted under 35 U.S.C. 154(b) by 0 days.

(21) Appl. No.: 09/943,662

(22) Filed: Aug. 31, 2001

(30) Foreign Application Priority Data

Sep. 1, 2000 (KR) ..... 00-51657
Sep. 1, 2000 (KR) ..... 00-51663

(51) Int. Cl.[7] ..... F24F 7/00
(52) U.S. Cl. ..... 454/324; 454/313; 454/370
(58) Field of Search ..... 454/370, 285, 454/313, 322, 324, 233

(56) References Cited

U.S. PATENT DOCUMENTS 5,388,426 A 2/1995 Wada et al.
5,660,588 A * 8/1997 Kotoh et al. ..... 454/285
5,769,709 A 6/1998 Kim
5,873,780 A * 2/1999 Mori et al. ..... 454/285

* cited by examiner

*Primary Examiner*—Harold Joyce
*Assistant Examiner*—Derek S. Boles
(74) *Attorney, Agent, or Firm*—John P. White; Cooper & Dunham LLP

(57) ABSTRACT

An actuating device for actuating a shutter is provided with a vertical guiding plate formed on both sides of the shutter to extend in a lengthwise direction thereof, a united guiding groove divided into a triangular guiding groove having a widened width for guiding the vertical guiding plate and an inclined guiding groove having a narrow width and formed in an inclined form at a predetermined angle, a vertical movement member having a movement member protuberance provided with a hinge at which one end of an actuating rod is connected, the other end of the actuating rod being connected to a shutter protuberance formed on a rear surface of the shutter, and a slip prevention protuberance having a tooth shaped configuration protruding from a front surface thereof, a roller resiliently contacted on the slip prevention protuberance of the vertical movement member; and a driving motor whose rotating shaft is inserted into the roller for actuating the vertical movement member upwardly and downwardly by being supplied with electric power.

4 Claims, 7 Drawing Sheets

DEVICE FOR ACTUATING A SHUTTER FORMED THROUGH A FRONT PANEL OF AN AIR CONDITIONER

FIELD OF THE INVENTION

The present invention relates to a device for actuating a shutter of an air conditioner; and, more particularly, device for actuating a shutter of an air conditioner, wherein a pair of vertical guiding plates formed on both sides of the shutter for opening and closing an outlet window formed through a front panel of the air conditioner to extend a predetermined length and a pair of united guiding grooves each provided with a triangular guiding groove for guiding vertical movements of the vertical guiding plate, into which the vertical guiding plate is inserted, and provided, a sliding bar having a plurality of oil grooves are formed on an inner frame, thereby facilitating and assembling the shutter into a guiding member and simplifying the configuration of the guiding member as well as allowing a proper opening/closing functions of the shutter.

DESCRIPTION OF THE PRIOR ART

In general, an air conditioner such as a heater or an air-cooling device is used to effectively increase or lower the temperature of the air inside buildings or home.

The air conditioner, especially the air-cooling device, two kinds of devices, e.g., a wall-type device hung on a wall and a stand type device standing on the bottom are mainly used. Since the wall-type device has less capacity and is normally mounted on a window, it is used for a room and a small sitting room. The stand-type device is normally used for a sitting room of a large apartment and a commodious single house because of its high capacity.

Such stand-type air conditioner has an air-blowing window normally assembled on the upper frontal portion, and an air-directing unit for adjusting the direction of the air formed in the air-blowing window.

Further, the air-directing unit includes a vertical adjustment plate for adjusting the direction of the air flow in a vertical and horizontal adjustment plate for adjusting the direction of the air flow in a horizontal direction, to allow effectively send the air flow toward the direction desired.

In recent days, a shutter has been installed on the rear side in order to prevent alien material from passing through the air-blowing window of the main body of the air conditioner.

Hereunder, a prior art operating device for actuating the shutter of the air conditioner is explained.

FIG. 1 shows an exploded perspective view of a prior art device for actuating a shutter used in air conditioner; and FIG. 2 illustrates a cross sectional view of the prior art actuating device shown in FIG. 1.

The prior art operating device for actuating the shutter includes an air blowing window 16 where the cooled air is discharged, the air blowing window 16 formed through a front panel 12 of a main body 10 of an air conditioner equipped with various mechanisms, a shutter 20 installed on the rear side of the air-blowing window 16 to open/close simultaneously, a guiding member 30 having a guiding groove 32 into which a guiding lug 22 formed on both sides of the shutter 20 to protrude therefrom is inserted, an actuating rod 70 which one end is connected to a shutter protuberance 124 for actuating the shutter 20, a rack connecting member 60 having a hinge 64 hinged to the other end of the actuating rod 70 and resiliently operated by a spring 80, a rack gear 50 vertically operated and having a hole 52 into which the rack connecting member 60 is inserted, the hole 52 for guiding the rack connecting member 60, and a guiding slot 54 for leading a guiding protuberance 62 of the rack connecting member 60, and a driving motor 40 whose rotating shaft 42 is inserted into a pinion gear 44 engaged with the rack gear under supply of electric power.

As shown in FIG. 2, when the rack gear 50 engaged with the pinion gear 44 is moved down by the operation of the driving motor 40, the guiding protuberance 62 is inserted into the guiding slot 54 of the rack gear 50, allowing the rack connecting member 60 to be moved downwardly at the same time.

The downward movement of the rack connecting member 60 allows the actuating rod 70 connected to the hinge 64 to pull down the rear side of the shutter 20.

When the actuating rod 70 pulls down the shutter 20 from the rear side of the shutter 20, the guiding lug 22 is moved down along the guiding groove 32 of the guiding member 30, resulting that the shutter 20 opens the air-blowing window 16 of the front panel 12.

When the driving motor 40 is rotated in an opposite direction, the shutter 20 is closed by reversed a contrary process, shutting off the air-blowing window 16 of the front panel 12.

For a proper vertical movement of the rack gear 50 driven by the driving motor 40, lubricating oil is applied between a bar groove 56 formed on a rear surface of the rack gear 50 and a sliding bar 12*a* protruding from a rear surface of the front panel 12 and engaged to the bar groove 56.

An air direction adjustment member 90 is installed on the rear portion of the shutter 20 and a fixing protuberance 96 of a vertical adjustment plate 94 of the air direction adjustment member 90 is inserted into a fixing hole 34 of the guiding member 30 to change the direction of the air vertically.

Further, a horizontal adjustment plate 92 serves to horizontal direction.

The prior art actuating device for actuating the shutter, however, has several shortcomings.

Firs of all, since the rack gear 50 engaged with the pinion gear 44 driven by the driving motor 40 is moved up and down to close/open the air-blowing window 16 without a particular cushioning means except a spring cushioning the rack connecting member 60, the configuration of the device becomes complex and the engagement between the pinion gear 44 and the rack gear 50 tends to generate a significant noise problem.

Further, in case that alien material is interposed in the shutter 20, it is easy for the rack gear and the pinion gear to be damaged.

Furthermore, since the guiding groove 32 of the guiding member 30 includes two separated guiding grooves and the guiding lugs 22 formed at both lateral positions of the shutter 20 are inserted into those different guiding grooves, it is difficult to make or prepare a molding die fitted into the separated guiding grooves and the guiding member 30 cames a problem where the it becomes weak and wider.

Moreover, if the guiding lugs 22 formed at the shutter 20 is abruptly broken by, e.g., a shock, the shutter cannot be properly moved in the guiding member 30.

In addition, since the lubricating oil applied between the sliding bar 12*a* and the bar groove 56 of the rack gear 50 is dried out due to repeated opening/closing operations, the lubricating function between the sliding bar 12*a* and the bar groove 56 of the rack gear 50 is degraded after a use of a long period of time, increasing a possibility for the components to be damaged or worn out and finally disabling the operation of the shutter.

SUMMARY OF THE INVENTION

Therefore, the primary objective of the invention is to provide an actuating device for actuating a shutter of an air conditioner, wherein a pair of vertical guiding plates formed on both sides of the shutter for opening and closing an outlet window formed through a front panel of the air conditioner to extend a predetermined length and a pair of united guiding grooves each provided with a triangular guiding groove for guiding vertical movements of the vertical guiding plate, into which the vertical guiding plate is inserted, and provided a sliding bar having a plurality of oil grooves are formed on an inner frame, thereby facilitating the assemble of the shutter into a guiding member and simplifying the configuration of the guiding member as well as allowing a proper opening/closing functions by the shutter.

The above and other objects of the invention are accomplished by providing an operating device for actuating a shutter provided with an outlet window through which a cooled air generated within an air conditioner is discharged outwardly, the outlet window formed through a front panel of the main body of an air conditioner, a shutter for opening and closing the outlet window, a guiding member for guiding movements of the shutter, and an air direction adjustment mounted on a rear portion of the shutter for adjusting the direction of a discharged air by using vertical and horizontal adjustment plates, comprising: a vertical guiding plate formed on both sides of the shutter to extend in a lengthwise direction thereof; a united guiding groove divided into a triangular guiding groove having a widened width for guiding the vertical guiding plate and an inclined guiding groove having a narrow width and formed in an inclined form at a predetermined angle; a vertical movement member having a movement member protuberance provided with a hinge at which one end of an actuating rod is connected, the other end of the actuating rod being connected to a shutter protuberance formed on the rear surface of the shutter, and a slip prevention protuberance having a tooth shaped configuration protruding from the front surface thereof, a roller resiliently contacted on the slip prevention protuberance of the vertical movement member; and a driving motor whose rotating shaft is inserted into the roller for actuating the vertical movement member upwardly and downwardly by being supplied with electric power.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Hereunder, a detailed description of the present invention is now made with the reference to the attached drawings.

Figure 1:
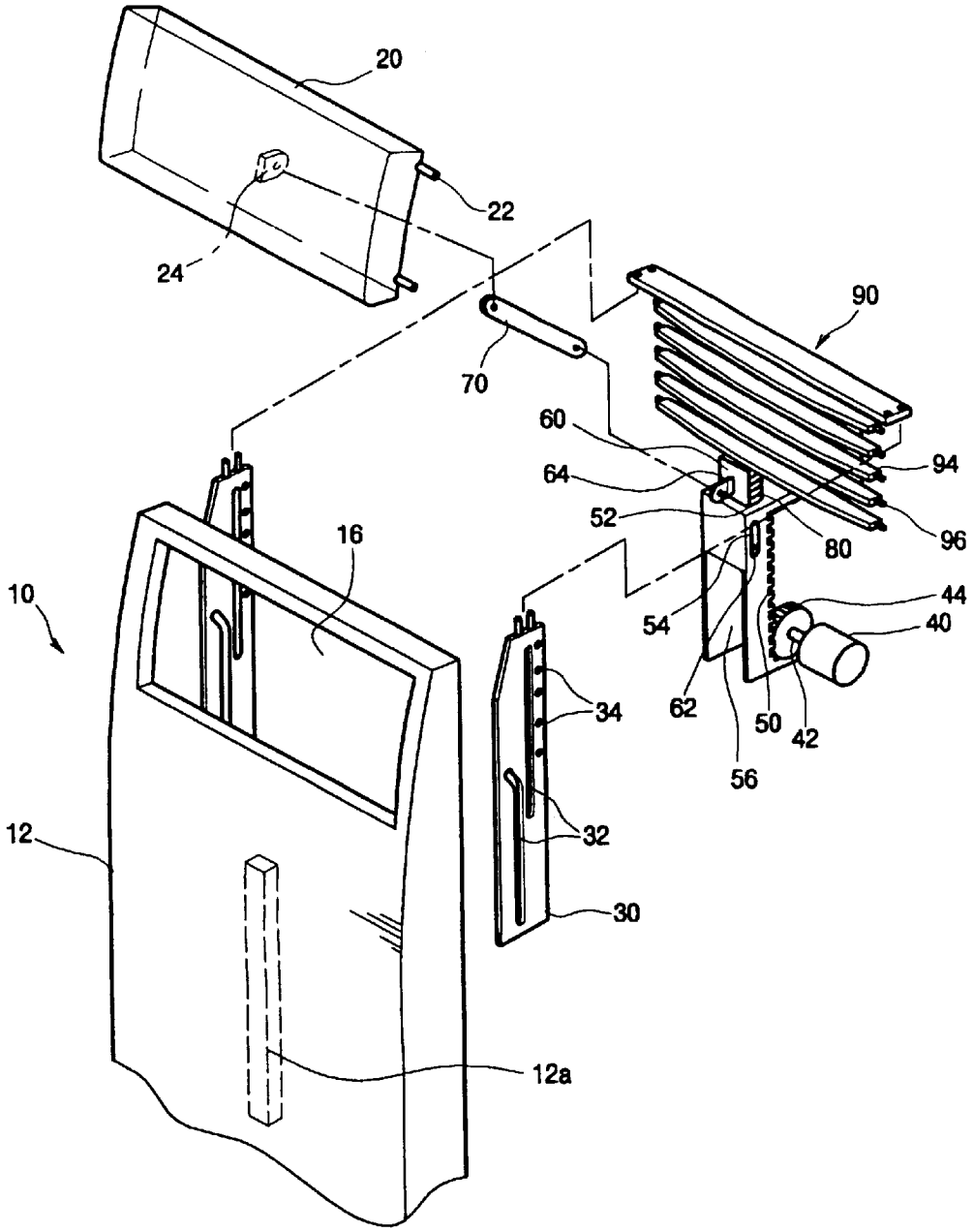
FIG.1 (PRIOR ART)
FIG. 1 shows an exploded perspective view of a prior art device for actuating a shutter used in air conditioner.
Figure 2:
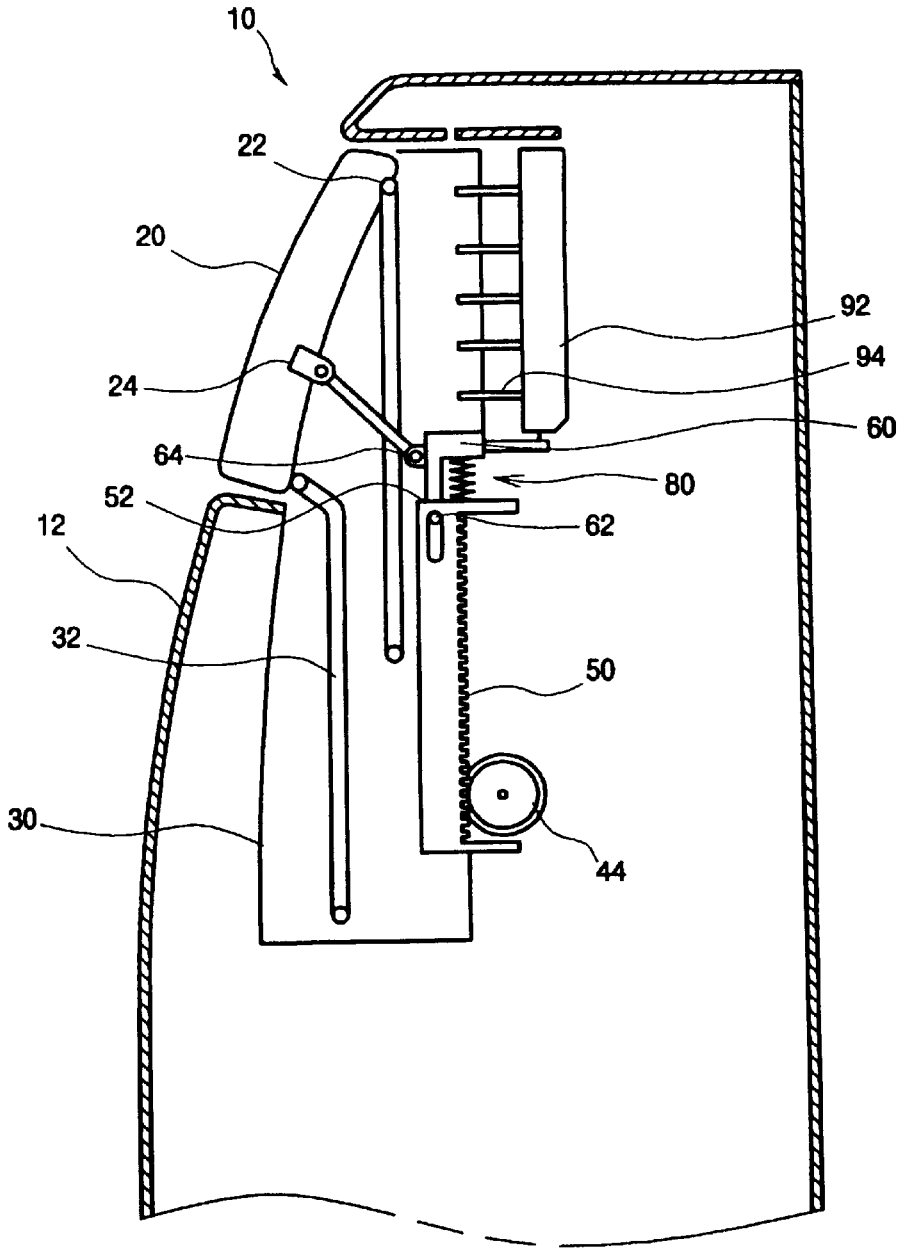
FIG.2 (PRIOR ART)
FIG. 2 illustrates a sectional view of the prior art actuating device shown in FIG. 1.
Figure 3:
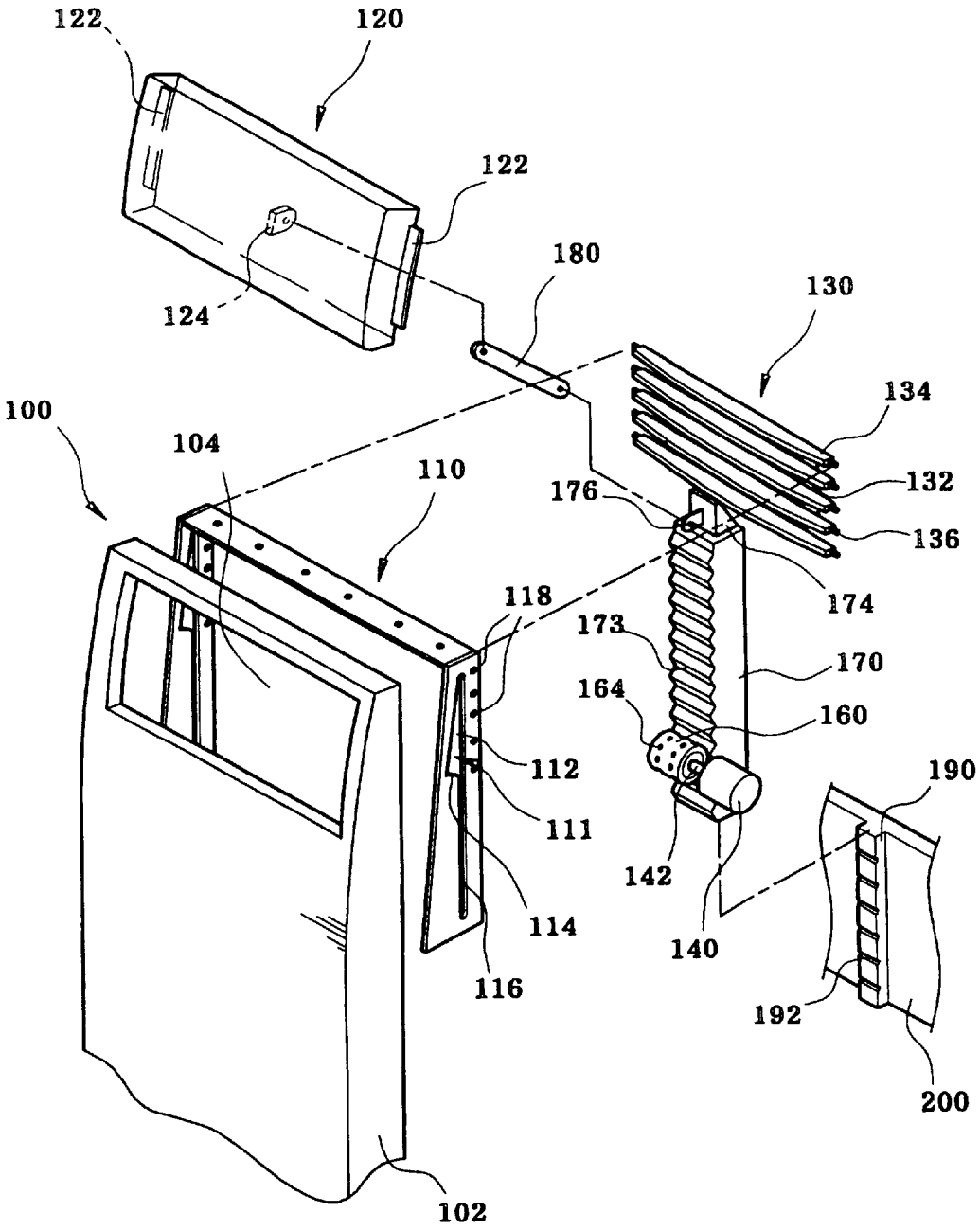
FIG. 3 illustrates an air conditioner provided with a guiding device for guiding an auto-shutter in accordance with the present invention.
Figure 4:
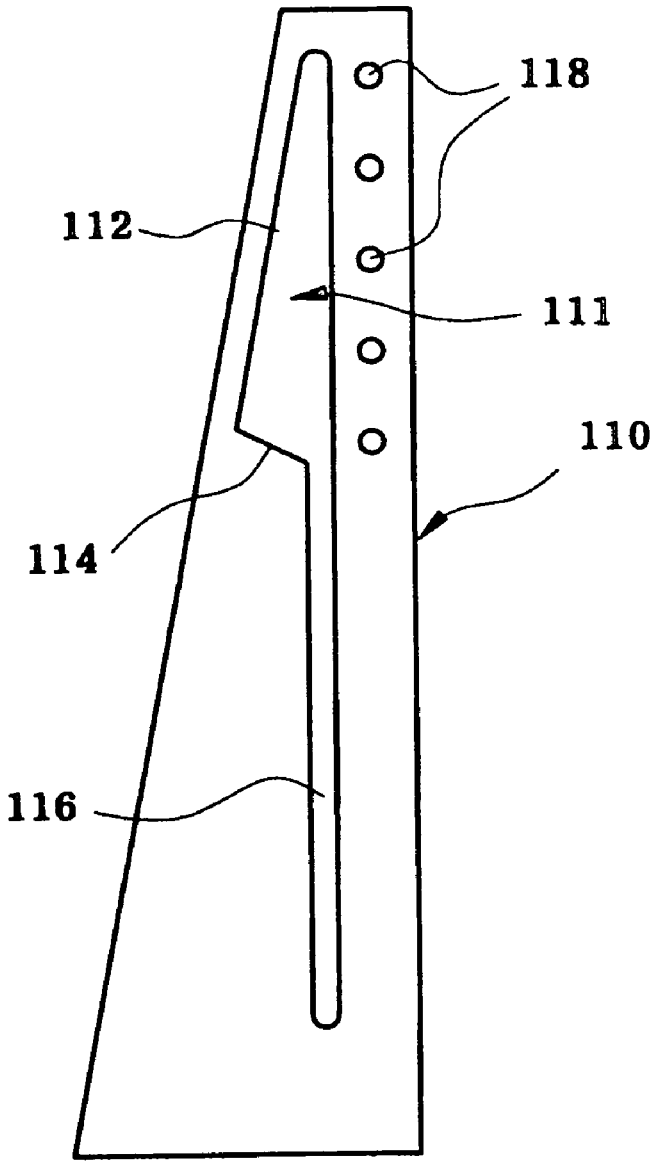
FIG. 4 shows a guiding member provided with a united guiding groove in accordance with the present invention.
Figure 5:
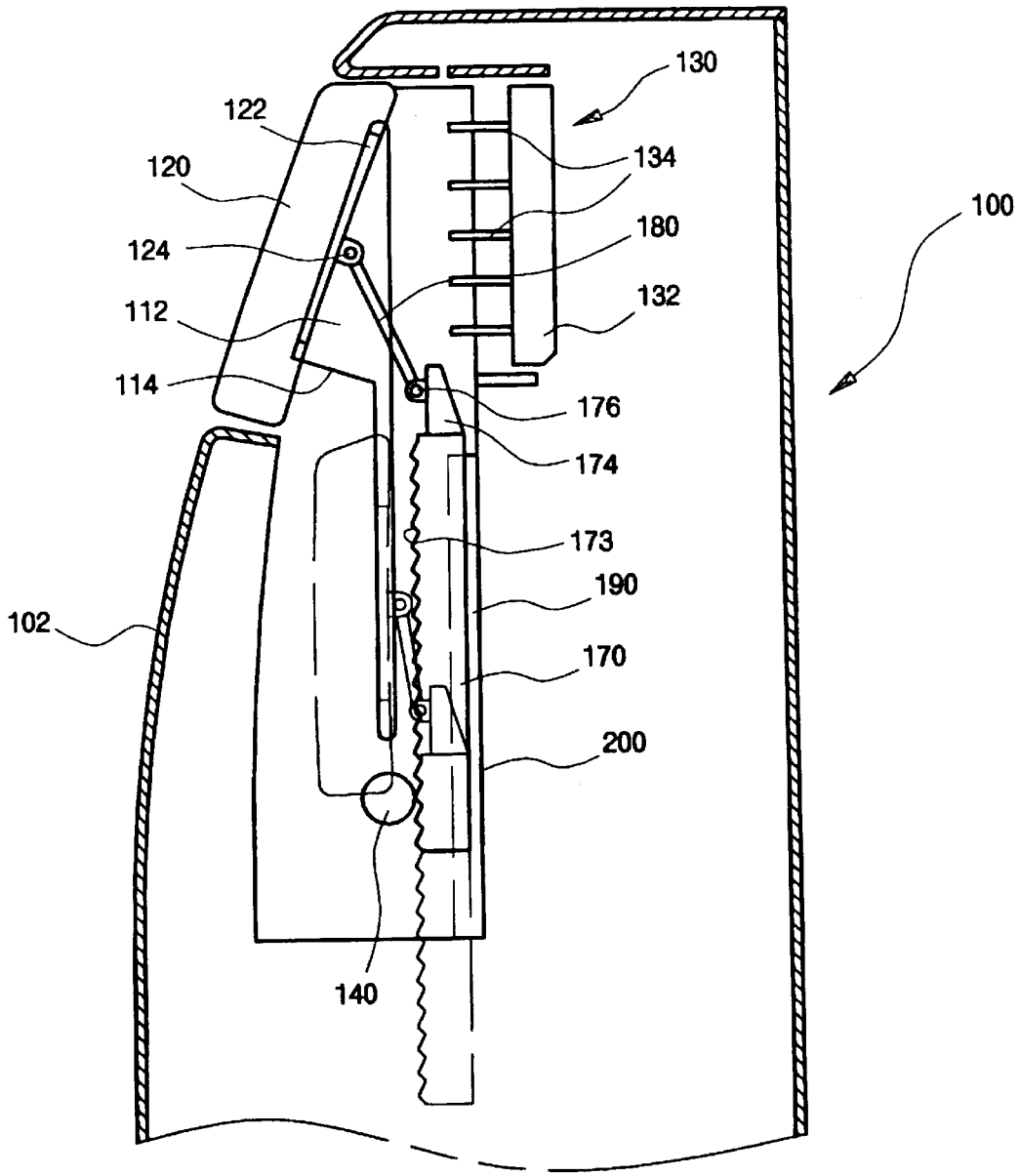
FIG. 5 depicts the inventive guiding device for guiding the auto-shutter in an operative state.
Figure 6:
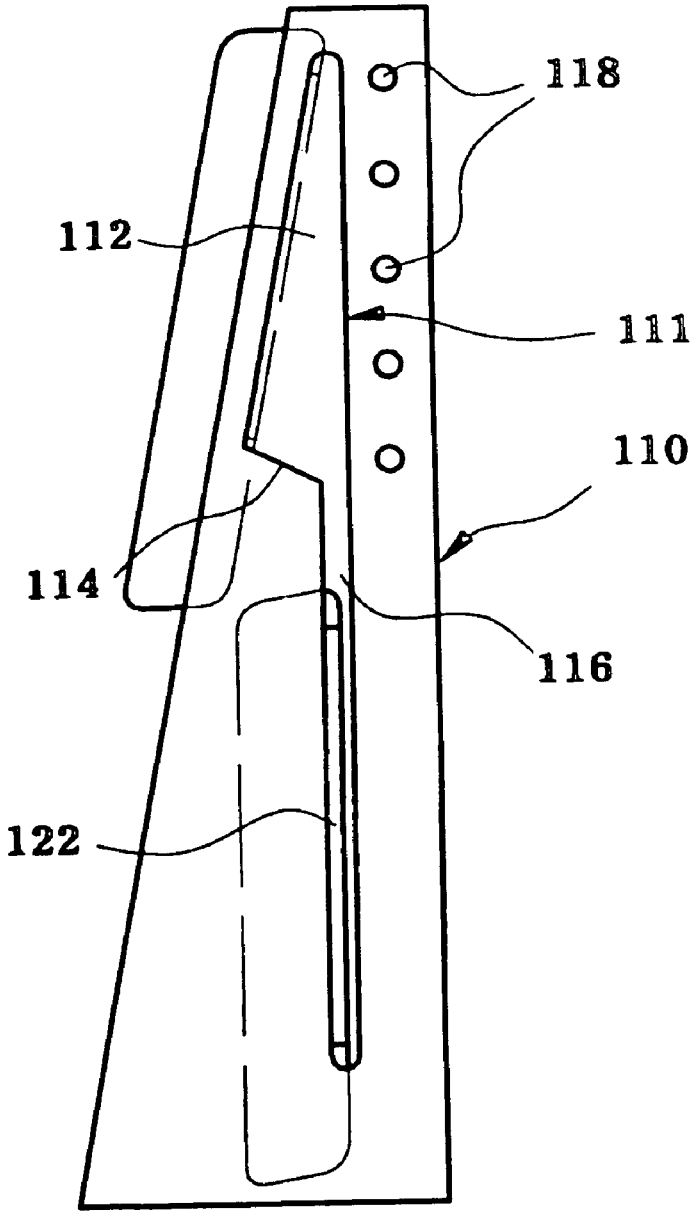
FIG. 6 describes movements of an upper short protuberance and a lower long protuberance of the auto-shutter in the united guiding groove of the guiding member in accordance with the present invention.

FIG. 3 illustrates an air conditioner provided with a guiding device for guiding an auto-shutter in accordance with the present invention, FIG. 4 shows a guiding member provided with a united guiding groove in accordance with the present invention, FIG. 5 depicts the inventive guiding device for guiding the auto-shutter in an operative state, and FIG. 6 describes movements of an upper short protuberance and a lower long protuberance of the auto-shutter in the united guiding groove of the guiding member in accordance with the present invention.

The inventive actuating device for actuating an auto-shutter provided with an outlet window through which a cooled air generated within an air conditioner is discharged outwardly, the outlet window formed through a front panel 102 of a main body 100 of an air conditioner, a shutter 120 for opening and closing the outlet window 104, a guiding member 110 for guiding movements of the shutter 120, and an air direction adjustment 130 mounted on the rear portion of the shutter 120 for adjusting a direction of a discharged air by using vertical adjustment plates 134 and horizontal adjustment plates 132, comprises a vertical guiding plate 122 formed on both sides of the shutter 120 to extend in a lengthwise direction thereof, a united guiding groove 111 divided into a triangular guiding groove 112 having a widened width for guiding the vertical guiding plate 122 and an inclined guiding groove 116 having a narrow width and formed in an inclined form at a predetermined angle, a vertical movement member 170 having a movement member protuberance 174 provided with a hinge 176 at which one end of an actuating rod 180 is connected, the other end of the actuating rod 180 being connected to a shutter protuberance 124 formed on a rear surface of the shutter 120, and a slip prevention protuberance 173 having a tooth shaped configuration protruding from the front surface thereof, a roller 160 resiliently contacted on the slip prevention protuberance 173 of the vertical movement member 170, and a driving motor 140 whose rotating shaft 142 is inserted into the roller 160 for generating the vertical movement member 170 upwardly and downwardly by being supplied by the electric power.

An inclined extension surface 114 inclined forwardly is formed on the portion where the triangular guiding groove 112 and the inclined guiding groove 116 meet each other.

The guiding member 110 is preferably made by using one molding die which can form the united guiding groove 111 and a plurality of fixing holes 118 simultaneously.

It is proper for the roller 160 to have on its external surface a resilient groove 164 for enlarging the contact area and exerting the resilient force. Further, it is preferred that the roller 160 be made of rubber having a good resilience.

Figure 7:
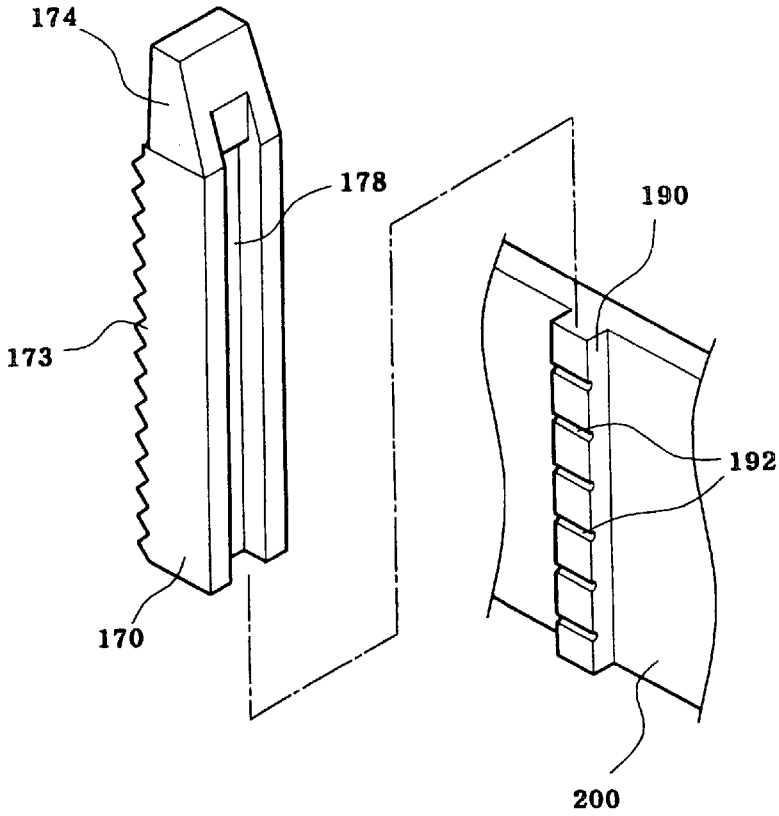
FIG. 7 describes an engagement between the vertical movement member and a sliding bar in accordance with the present invention.
Figure 8:
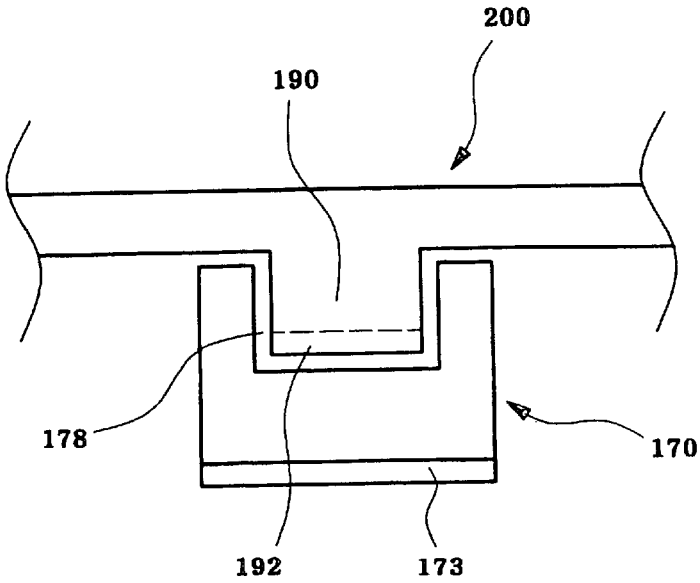
FIG. 8 represents a sectional view showing the engagement between the vertical movement member and the sliding bar.

FIG. 7 describes an engagement between the vertical movement member and a sliding bar in accordance with the present invention; and FIG. 8 represents a sectional view showing the engagement between the vertical movement member and the sliding bar.

In order for the vertical movement member 170 to properly move in the vertical direction, a slide groove 178 is formed on the opposite surface of the slip prevention protuberance 173 from the vertical movement member 170.

A sliding bar 190 for guiding the vertical movement of the vertical movement member 170, being inserted into the slide groove 178 is formed on a inner frame 200 to protrude toward the vertical movement member 170. An oil groove 192 is formed on the surface of the sliding bar 190, which can keep therein lubricating oil, in order to apply the lubricating oil between the slide groove 178 and the sliding bar 190. It is preferable that a plurality of oil grooves 192 be made.

Hereinafter, operation and effectiveous of the present invention are now described in detail.

As shown in FIG. 5, when the air conditioner is not used as usual, the outlet window 104 of the front panel is closed by the shutter 120 with the vertical movement member 170 being positioned uppermost, in order to prevent alien material such as dirt from being introduced through the outlet window 104.

When the user wants to operate the shutter 120 to open the outlet window 104, an operation panel (not shown) normally mounted on the front panel 102 of the main body 100 of the air conditioner is operated to trigger the driving motor 140 which in turn rotates the roller 160 mounted to the rotating shaft 142 to move down the vertical movement member 170 contacted to the slip prevention protuberance 172.

In response to the downward movement of the vertical movement member 170, the actuating rod 180 hinged at the hinge 176 pulls down the shutter 120. At the same time, the vertical guiding plates 122 formed on the shutter 120 moves down into the inclined guiding groove 116 of the united guiding groove 111 along the united guiding groove 111, thereby opening the outlet window 104 of the front panel 102.

Through the outlet window 104 opened in a described manner, a cooled air generated by a cooling mechanism mounted on the upper portion of the main body 100 of the air conditioner is discharged from the air conditioner to cool a desired space.

When the user wants to close the outlet window 104 of the front panel 102 of the main body 100 of the air conditioner having been opened as described above, the driving motor 140 will be rotated in the opposite direction to move up the vertical movement member 170 which in turn moves up the shutter 120 through the actuating rod 180.

On the other hand, when the shutter 120 closes the outlet window 104, the vertical guiding plates 122 of the shutter 120 initially moves up along the inclined guiding groove 116 of the united guiding groove 111. When the vertical guiding plates 122 meets the inclined extension surface 114 during its upward movement, it is pushed in a direction toward the front panel 102 to be in a position shown in FIG. 6. Finally, the vertical guiding plates 122 are closely contacted on the triangular guiding groove 112 to shut off the outlet window 104 of the main body 100 of the air conditioner.

Further, in case the shutter 120 and the vertical movement member 170 can not be operated due to the alien material interposed in a shutter structure or other link structures, the rubber material of the roller 160 mounted to the driving motor 140 allows the roller 160 to be slipped on the slip prevention protuberance 172 during its rotational movement, preventing a damage of other linkage components.

Assembling the shutter 120 into the guiding member 110 is made in such a manner that portions of the guiding member 110 provided with the united guiding grooves 111, respectively are initially resiliently widened away from each other and the shutter 120 is pushed into between those portions with the vertical guiding plates 122 being kept in the united guiding grooves 111, respectively and finally the widened portions are allowed to return to their initial positions.

Moreover, when the lubricating oil is applied between the slide groove 178 and the sliding bar 190 having the oil grooves 192, a predetermined amount of the oil is kept in the oil groove 192, lubricating during a prolonged period of time is available, allowing a proper engagement between the slide groove 178 and the sliding bar 192 operated in the slide groove 178. Especially, when the number of the oil grooves 192 is increased, lubrication of a whole region between the sliding bar 190 and the slide groove 178 during an increased period of time is ensured.

In accordance with the present invention, since the vertical guiding plates formed on both sides of the shutter for opening and closing the outlet window formed through the front panel of the air conditioner to extend a predetermined length and the united guiding grooves provided with the triangular guiding grooves, respectively, for guiding the vertical guiding plates, into which the vertical guiding plates are inserted and provided, it is easy to assemble the shutter into the guiding member and the configuration of the guiding member can be simplified.

Further, damaging the vertical guiding plates of the shutter can be reduced.

The molding die for the guiding member becomes simplified, thereby facilitating the manufacturing process thereof, since the guiding grooves are integrally formed with the guiding member.

Finally, since the lubricating oil can be kept in the oil groove formed on the sliding bar during a prolonged period of time, wearing between the sliding bar and the slide grooves can be reduced, thereby ensuring that the shutter properly opens/closes the outlet window.

Although the invention has been shown and described with respect to the preferred embodiments, it will be understood by those skilled in the art that various changes and modifications may be made without departing from the spirit and scope of the invention as defined in the following claims.

What is claimed is:

1. An actuating device for actuating a shutter provided with an outlet window through which a cooled air generated within an air conditioner is discharged outwardly, the outlet window formed through a front panel of a main body of the air conditioner, a shutter for opening and closing the outlet window, a guiding member for guiding movements of the shutter, and an air direction adjustment mounted on a rear portion of the shutter for adjusting a direction of a discharged air by using vertical adjustment plates and horizontal adjustment plates, comprising:

a vertical guiding plate formed on both sides of the shutter to extend in a lengthwise direction thereof;

a united guiding groove divided into a triangular guiding groove having a widened width for guiding the vertical guiding plate and an inclined guiding groove having a narrow width and formed in an inclined form at a predetermined angle;

a vertical movement member having a movement member protuberance provided with a hinge at which one end of an actuating rod is connected, the other end of the actuating rod being connected to a shutter protuberance formed on a rear surface of the shutter, and a slip prevention protuberance having a tooth shaped configuration protruding from the front surface thereof;

a roller resiliently contacted on the slip prevention protuberance of the vertical movement member; and a driving motor whose rotating shaft is inserted into the roller for actuating the vertical movement member upward and downward by being supplied with electric power.

2. The actuating device of claim 1, wherein an inclined extension surface inclined forwardly is formed on a portion where the triangular guiding groove and the inclined guiding groove meet each other.

3. The actuating device of claim 1, wherein said roller has on its external surface a resilient groove for enlarging the contact area and exerting the resilient force.

4. The actuating device of claim 1, wherein said vertical movement member has on its surface a slide groove and a sliding bar for guiding the vertical movement of the vertical movement member, being inserted into the slide groove is formed on a inner frame to protrude toward the vertical movement member, while an oil groove being formed on a surface of the sliding bar, which can keep therein lubricating oil.

* * * * *